United States Patent [19]

Lunde

[11] 4,199,956

[45] Apr. 29, 1980

[54] ICE CUBE MAKING MACHINE

[76] Inventor: Howard L. Lunde, Rte. 1, Oconto, Wis. 54153

[21] Appl. No.: 948,456

[22] Filed: Oct. 4, 1978

[51] Int. Cl.[2] ..... F25C 1/20

[52] U.S. Cl. ..... 62/138; 62/352; 366/241

[58] Field of Search ..... 62/68, 138, 352; 366/241, 256, 259, 257; 74/25

[56] References Cited

U.S. PATENT DOCUMENTS

| | | | |
|---|---|---|---|
| 1,450,238 | 4/1923 | Ayers et al. | 366/257 |
| 3,027,731 | 4/1962 | Lindenberg et al. | 62/138 |
| 3,380,261 | 4/1968 | Hendrix et al. | 62/138 |
| 3,418,823 | 12/1968 | Vivai | 62/138 |
| 3,482,413 | 12/1969 | Mann et al. | 62/68 |
| 3,791,166 | 2/1974 | Maleck | 62/138 |
| 4,045,979 | 9/1977 | Mazzini | 62/352 |
| 4,048,891 | 9/1977 | Pearl | 74/25 X |

*Primary Examiner*—Albert J. Makay
*Assistant Examiner*—William E. Tapolcai, Jr.
*Attorney, Agent, or Firm*—Wheeler, Morsell, House & Fuller

[57] ABSTRACT

An ice cube making machine includes agitator paddles which oscillate or reciprocate in a horizontal path between freezing elements to agitate the water to provide clear ice cubes. An ice cube thickness sensor is carried by the agitating paddle assembly and moves in a path toward and away from the cube. When the desired ice cube thickness has been attained, the sensor actuates circuitry to interrupt the freezing cycle and initiate the harvest cycle. Control of the various functions of the machine is afforded by a compact control module which contains proximity switches located adjacent exterior faces of the module and eliminates the need for limit switches. Feelers or links containing switch actuating magnets swing past the proximity switches to initiate or trigger or discontinue the various cycles. Also disclosed is a freezing element for an evaporator about which the cubes form and which has a copper shell or jacket which is closed at one end and which receives copper tubing in the other end for supply of refrigerant. The copper shell is crimped about the copper tubing and brazed to provide a seal. The rounded end of the element causes formation of a cube with a rounded end so that the only generally planar surface is the top of the cube. This minimizes broad surface to surface contact with adjacent cubes in the storage bin, such as with square cubes, which can result in cubes freezing together in clusters.

8 Claims, 9 Drawing Figures

Fig. 5
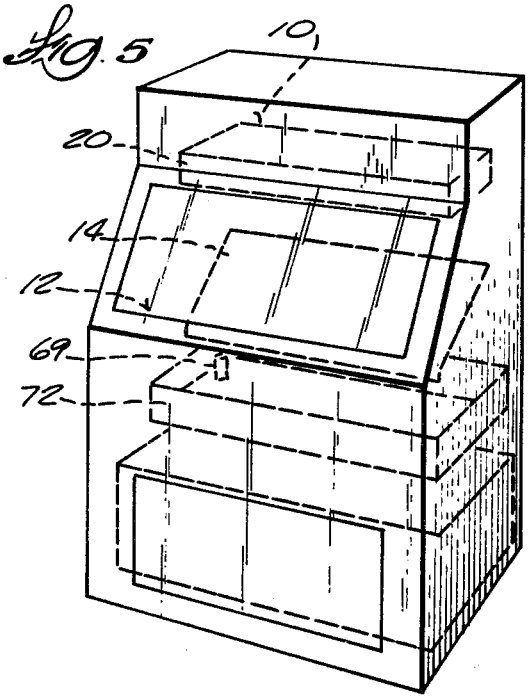
Fig. 6
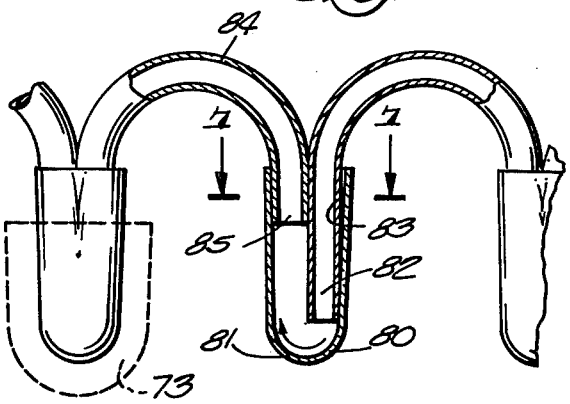
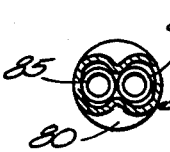
Fig. 7
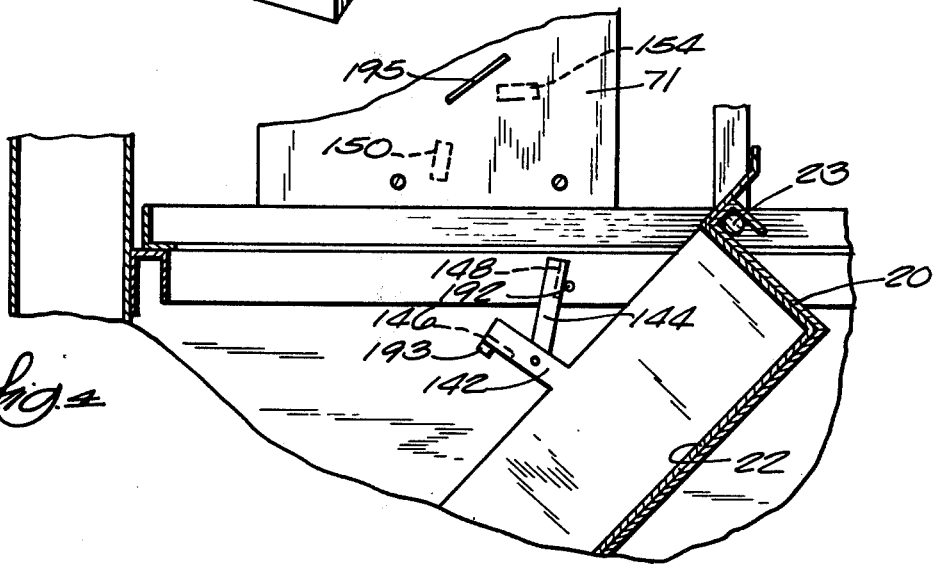
Fig. 4
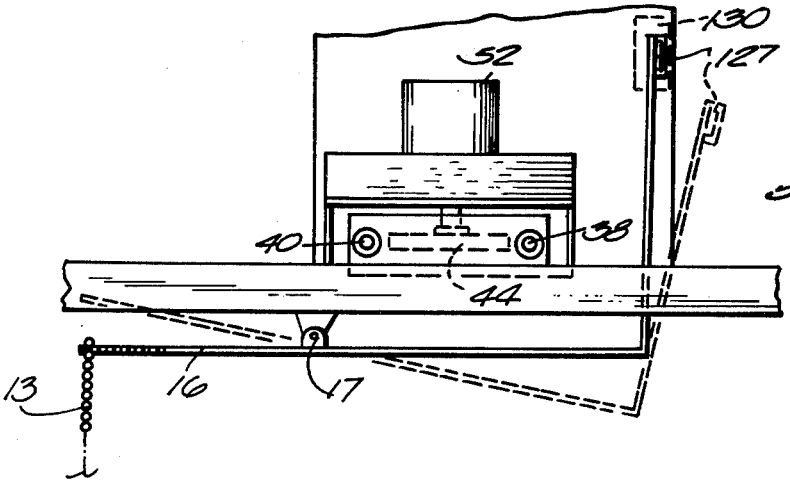
Fig. 3

Fig. 8
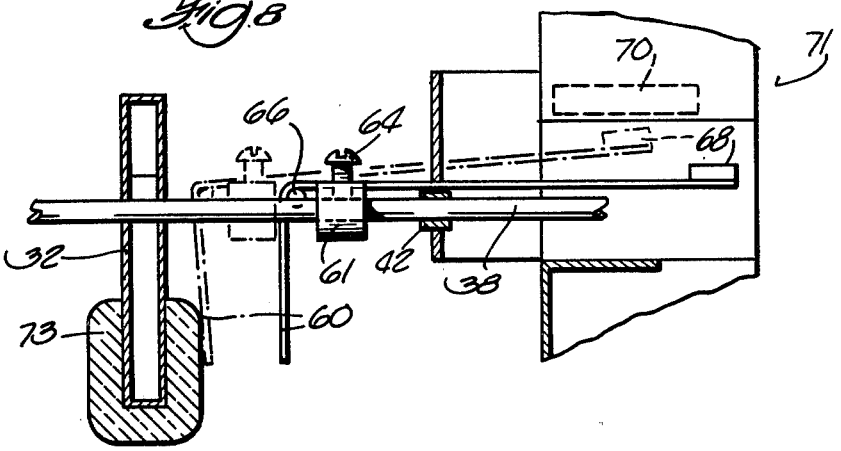
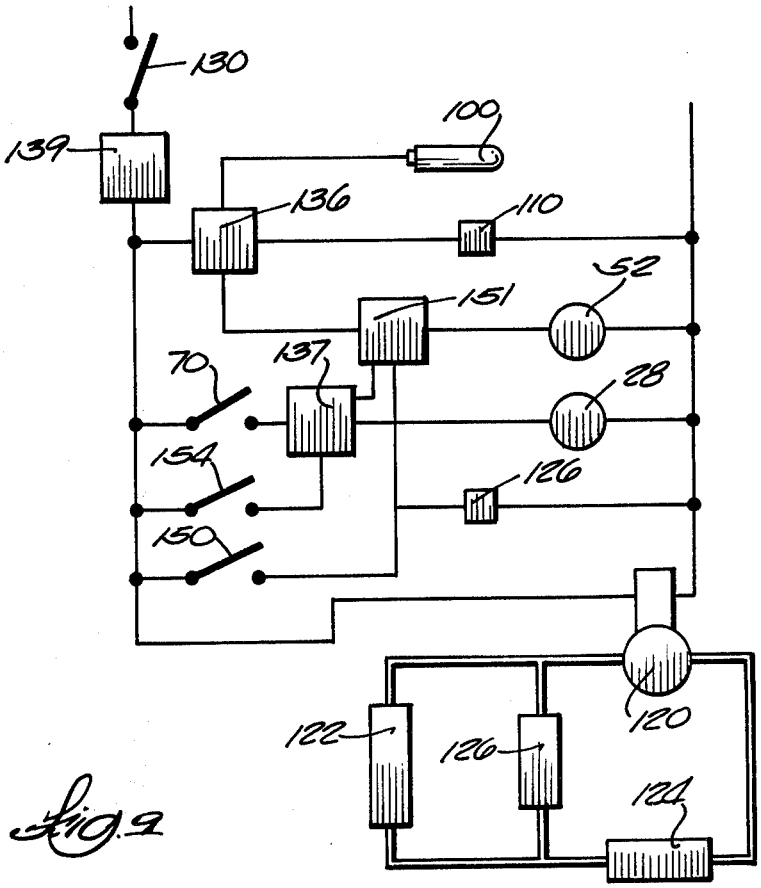
Fig. 9

ICE CUBE MAKING MACHINE

BACKGROUND OF THE INVENTION

The invention relates to improvements in ice cube making machines of the type employing a refrigeration system with an evaporator having a plurality of small elements which project into a water pan. The cubes form around the elements and during the harvest cycle are released from the elements into the pan by circulating hot gas through the elements to melt the adjacent surfaces of the cube. The cubes are harvested from the pan by tilting the pan to dump the cubes into a storage bin.

It is known that agitation or movement of water during the freezing thereof is necessary to form the highly preferred clear ice cubes rather than cloudy or opaque cubes formed in home refrigerators. Various techniques have been employed to accomplish agitation. In the Lindenberg U.S. Pat. No. 3,027,731, a rotary agitator containing a rotating shaft and rotating paddle elements which move in between the freezing elements causes agitation of the water. Because the paddles move into and above the water in the water pan during rotation thereof, dripping water from the raised paddles splashes and causes disturbance upon the surface of the water which results in a non-uniform irregular surface on the tops of the ice cubes at the water surface.

Other techniques employed for agitation of water in the ice making pan include the use of pumps which circulate and recirculate the water. Clogging and other maintenance problems of the pumps are disadvantages of this approach.

Ice making machines require some type of sensor to stop the freezing cycle or start the harvest cycle. In the Lindenberg U.S. Pat. No. 3,027,731, the freezing cycle is stopped when the rotating paddles strike forming ice cubes to cause a torque which displaces a pivoted motor to actuate an electrical switch and stop the freezing cycle.

The foregoing arrangement provides an impositive control of the cube size. Wear of the paddles can change the point in time during the freezing cycle when the paddles strike the developing cubes and thus change the thickness of the cubes. Systems of this type are not easily controlled to afford selection of different cube thicknesses.

SUMMARY OF THE INVENTION

The invention provides agitation of the water surrounding the freezing elements to obtain clear cubes with a uniform or smooth upper surface by use of a paddle assembly which is oscillated along a generally horizontal axis or axis parallel to the surface of the liquid in the ice making pan, with the paddles immersed in the water to minimize disturbance of the water surface. The paddles are connected to and depend from two or more paddle support rods which are interconnected and supported for horizontal reciprocable movement by bearings on opposite sides of the ice making water pan. The paddles remain immersed in the water of the ice making pan at a constant depth and hence do not cause splashing of water on the water surface. An agitator motor output shaft carries a cam or eccentric which is confined within frame parts fixedly connected to the paddle support rods. Rotation of the cam with the motor output shaft causes a rectilinear oscillation of the paddles. Other suitable mechanical arrangements could be employed to obtain this motion.

Further features of the ice cube making machine include an adjustable thickness sensor which is carried by the oscillating paddle support rods and which includes a switch actuating feeler arm pivotally supported on the support rods. The feeler arm oscillates with the paddles and is positioned in a path toward one of the many freezing elements of the evaporator. When the thickness of the ice formation on this freezing element reaches a predetermined thickness, the feeler is displaced about its pivot and a magnet carried by the feeler arm swings by a proximity switch to initiate the harvest cycle. The thickness feeler is connected to the agitating paddle assembly by a collar and set screw. Adjustment of the feeler position relative to the freezing element by use of the set screw enables selection of the desired cube thickness.

Other features of the invention include an adjustable depth sensing probe to control the depth of the water in the freezing pan and around the freezing elements to enable control and selection of cube length.

Economy of manufacture, simplicity of assembly and compactness of the parts is afforded by the use of a proximity switch housing which includes most of the electrical and control components other than the harvest motor and the solenoid valves for refrigerant water supply and hot gas. Proximity switches which control various functions are located within the housing and adjacent the surfaces thereof, and magnets carried by pivoted control arms swing past the housed proximity switches in response to mechanical movements of the various parts to initiate or control the machine cycles of freezing and harvesting. Thus the need for limit switches in various positions around the machine and the long wire connecting the switch is eliminated.

Pre-cooling of the water delivered to the ice making pan is afforded by a cooling coil located in the bin water pan where waste water is collected for discharge as the ice cubes are dumped from the freezing pan. This reduces the time of the freezing cycle and hence saves energy. The cooling coil is connected in series with the building plumbing system and the water supply solenoid valve which controls the water supply to the freezing pan.

The invention also provides a new freezing element which is inexpensive and relatively simple to manufacture. The freezing element comprises a slightly tapered thin walled cylindrical or tapered can or capsule which is spun or otherwise formed from copper or another good conductor and which has a closed, rounded end and an open end which receive the ends of two lengths of copper tubing which serves as a conduit for the refrigerant. The inlet and outlet tubes are inserted in the can and the can is upset or crimped about the tubing to conform to the shape of the tubing and is brazed to provide a seal. The end of the outlet tube is spaced above the end of the fill or supply tube to insure that the interior of the capsule is filled with refrigerant. The rounded end of the freezing element results in a cube with a complementary rounded end which does not afford broad based contact with adjacent cubes to minimize the cubes freezing into clusters in the storage pin.

Further objects, advantages and features of the invention will become apparent from the disclosure.

DETAILED DESCRIPTION OF THE DRAWINGS

FIG. 3 is a view taken along lines 3—3 of FIG. 2.

FIG. 4 is a fragmentary side elevational view showing a switch actuator.

FIG. 5 is a perspective view in reduced scale of the ice making machine.

FIG. 6 is a view of freezing elements made in accordance with the invention.

FIG. 7 is a sectional view along line 7—7 of FIG. 6.

FIG. 8 is a view of the cube thickness sensor.

FIG. 9 is a view of a circuit which can be employed for operating the ice machine.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
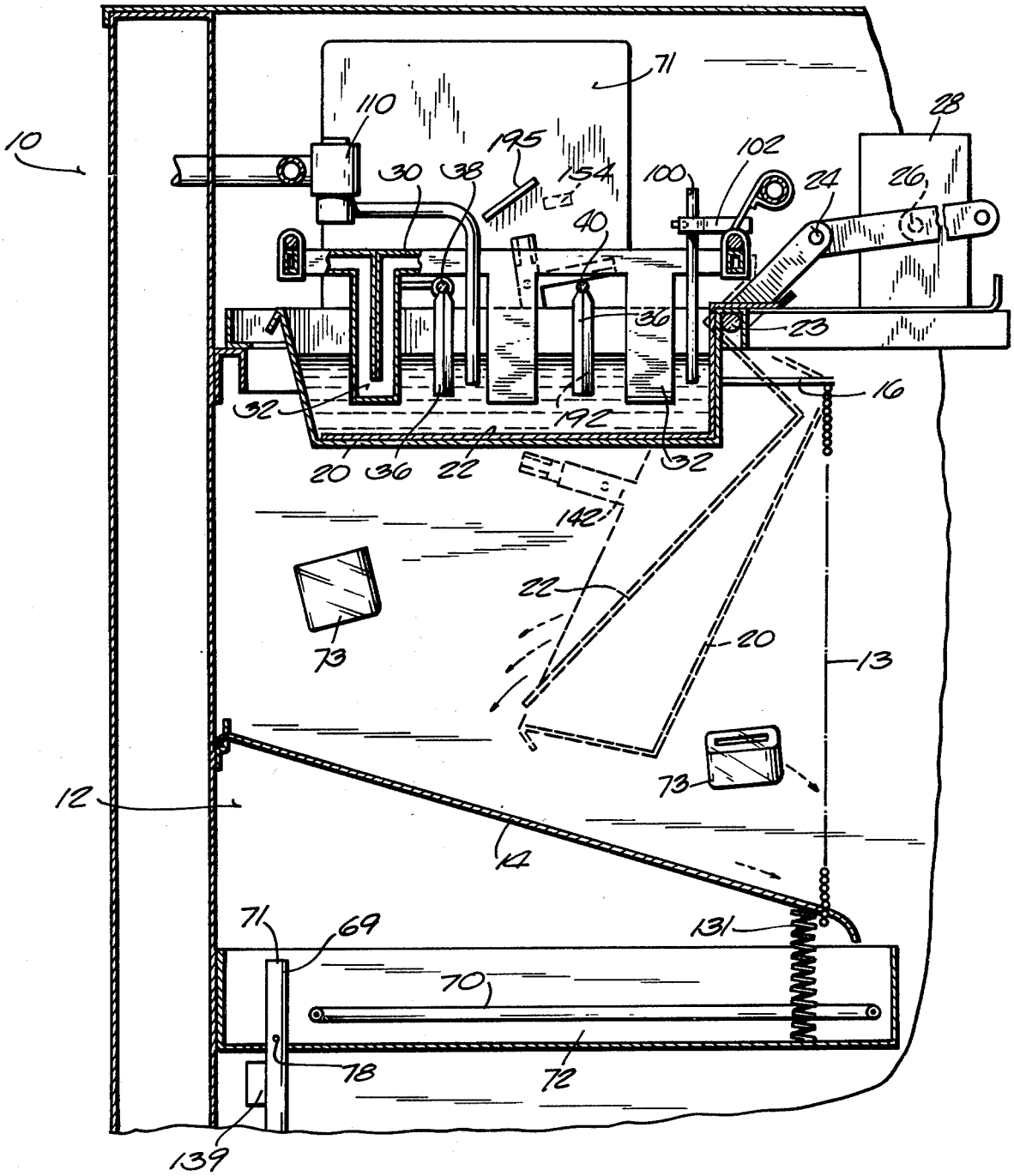
FIG. 1 is a fragmentary side elevational view in partial section of an ice cube making machine in accordance with the invention.

In the drawings, FIG. 1 discloses a frame or housing 10 which has walls defining an ice cube collection bin 12. The bin 12 has a hinged deflector 14 which is connected to a switch control arm 16 by a chain 13 (FIG. 3) which will shut off the machine when the bin accumulates a predetermined ice cube load and the deflector 14 is displaced downwardly.

The machine 10 is provided with an ice making water pan 20 with a false bottom 22 which is employed to eject the cubes from the pan as subsequently described. The pan 20 is pivotally supported on a support bar 23 and is connected to a linkage 24 which is driven by the output shaft 26 of a harvest motor 28 for movement between the solid line pan position of FIG. 1 during the freezing cycle to the broken line dumping position.

Figure 2:
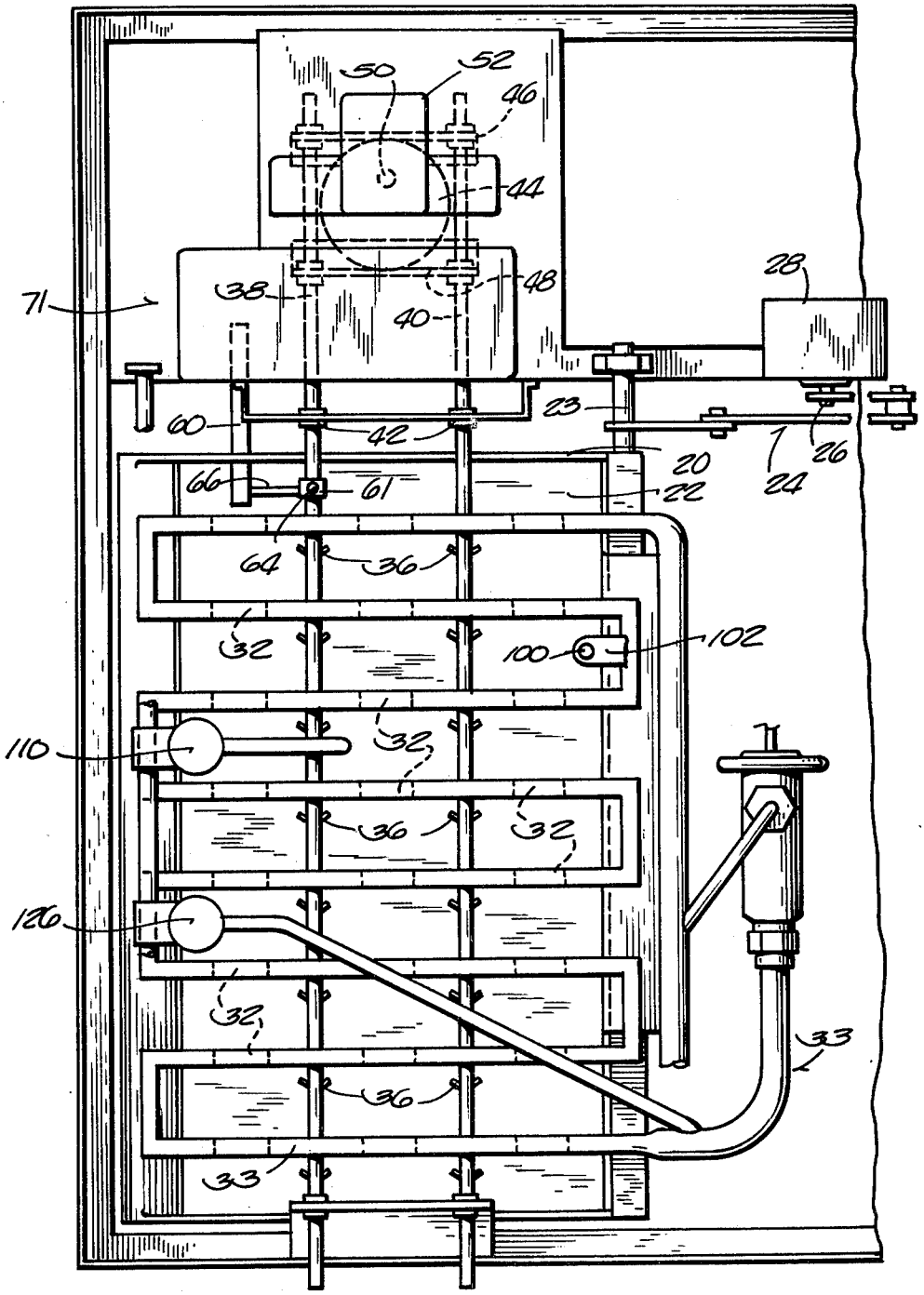
FIG. 2 is a plan view of the apparatus shown in FIG. 1.

FIG. 1 also illustrates the evaporator 30 which has a plurality of freezing elements 32 which are connected to form a continuous conduit for refrigerant. The elements are immersed below the upper surface of the water level in the pan 20 during the freezing cycle. The evaporator has three or more rows of elements 32 (FIG. 2) connected to a manifold 33 arranged in a serpentine path.

In accordance with the invention, agitating means are provided to agitate the water in the freezing pan 20 to provide clear rather than cloudy cubes. In the disclosed construction, the means comprises a plurality of paddles 36 (FIGS. 1 and 2) which are connected to and depend from paddle support rods 38 and 40 which are generally oriented in a horizontal plane and parallel to the surface of the water in the pan. Means are provided for oscillating the support rods in a horizontal rectilinear path with the paddles continuously immersed at the same depth. As disclosed, the means includes bearings 42 on the frame and adjacent the ends of the support rods 38, 40. The rods 38 and 40, and hence the paddles 36, are oscillated by a motor cam assembly in which a cam or eccentric 44 is captured between opposed frame members 46 and 48 which are fixedly connected to the rods 38 and 40. The cam 44 is fixed to the output shaft 50 of the agitator motor 52. Rotation of the output shaft 50 when the motor 52 is energized causes the frame members 40 and 50 and the rods 38 and 40 to move back and forth. The gentle oscillating motion of the paddles provides thorough agitation of the water without splashing to provide smooth, uniform cube tops.

In accordance with the invention, a sensor is provided to monitor the thickness of ice formation on one of the freezing elements 32, and when the desired cube thickness is sensed, stop the freezing cycle and initiate the harvest cycle. The sensor includes a feeler arm 60 which is adjustably supported on paddle support rod 38 by a collar 61 and screw 64. The feeler arm 60 is pivotally supported on a post 66 which is connected to the collar. As illustrated in FIG. 8, progressive ice buildup during cube formation will cause the pivoted feeler arm to swing upwardly (as shown in dotted lines in FIG. 8) when the feeler arm 60 engages an ice cube as it shuttles back and forth with the agitator paddles. A magnet 68 is carried by the feeler arm and, when the arm is displaced about post 66 as shown in FIG. 8, the magnet 68 will actuate a proximity switch 70 contained in control box 71 to actuate the harvest motor and initiate the harvest cycle as subsequently described. The adjustability of the collar 64 relative to support rod 38 enables adjustment of the position of the feeler arm 60 and thus the thickness of the ice cube 73 so that ice cubes with a desired thickness can be obtained.

To reduce energy costs and shorten the time interval of the freezing cycle, the pre-cooling of the water supply to the ice making pan can be circulated through a copper coil 75 located in a waste water pan 72 which catches the drippings from the ice making water pan. A standpipe 69 with an overflow opening 71 and small diameter metering discharge hole 78 regulates the water level in the pan 72 to insure that the coil 75 is immersed in cold water.

FIGS. 6 and 7 illustrate the evaporator freezing element of the invention which includes a spun or deep drawn copper shell or capsule 80 which has a slight taper toward the closed end 81 for release of cubes. The supply conduit 82 and the exhaust conduit 84 are in the form of copper tubing, such as 0.32 inch tubing, and are inserted in the shell 80 and the top crimped about the tubes as shown in FIG. 7 to provide a close fit. The tubes and the shell 80 are then sealed by brazing around the tubes and the crimped end at 83. The end 85 of tube 84 is positioned adjacent the top of the shell 80 to insure that the shell fills up with refrigerant. An evaporator having freezing elements 80 is substantially less expensive to manufacture than conventional types of elements as illustrated in FIG. 1.

The length of the ice cube, i.e. the dimension of the ice cube parallel to the longitudinal axis of the freezing element is controlled by a water depth sensor 100 (FIG. 1) which is adjustably supported on a bracket 102 connected to frame or housing parts. The sensor 100 can be a thermistor or the equivalent. When the water level fills the pan 20 to a point where it reaches the self heated thermistor, the thermistor will sense the difference in thermal conductivity between cabinet air and water and actuate, through suitable circuitry, a solenoid water valve 110 (FIGS. 1 and 9) to stop water flow into the pan 20. The depth of water in the pan 20 can be regulated by adjusting the position of the probe 100 to thus enable selecting the height of the formed cube.

FIG. 9 illustrates a typical circuit which can be employed to control the operating functions of the ice making machine. The refrigeration apparatus is diagrammatically illustrated and includes a motor compressor 120, a heat exchanger 122, an evaporator 124 and a hot gas valve 126. Other refrigeration circuit components typically employed in such equipment and not disclosed herein would be appropriately used with this circuit.

Various of the functions of the machine are controlled by proximity switches located in a common housing and actuated by magnets carried by linkages or feeler arms as previously described. The compressor 120 runs continuously, as illustrated in FIG. 9, except when the bin control switch 130 is opened as a result of downward displacement of the deflector 14 of the ice bin against the bias of a spring 131. In this regard, the arm 16 carrying magnet 127 (FIG. 3) is displaced by the chain 13 to provide a pulse which will open switch 130 through suitable circuity and shut down the machine. As illustrated in FIG. 3, the arm 16 can be provided with a series of notches for connection with a chain 13 composed of a series of interconnected spheres. With the chain connected close to the end of lever 16, more displacement of the deflector 14 is required to swing the magnet on arm 16 past the proximity switch 70. Thus a heavier cube load and greater cube accumulation is provided than if the chain 13 is connected close to the pivot for lever 16.

A semi-conductor switch 139 can be employed in the circuit to cooperate with proximity switch 130. As illustrated in FIG. 1, switch 139 can be supported on the standpipe 69 which serves to cool the heat sink, thus reducing the size and expense of the switch required to handle the compressor motor load. The freezing cycle is initiated whenever the ice making pan 20 is in the horizontal freezing position illustrated in full lines in FIG. 1. Water enters the pan through the solenoid valve until it reaches the tip of the probe 100 whereby a switch 136 will cause the solenoid water valve 110 to be closed and shut off the water supply to the pan 20. The agitator motor 52 continues running until the harvest cycle is initiated by operation of the cube thickness sensor 66. When the magnet 68 (FIG. 8) is flipped past the switch 70 in housing 71, it provides a signal which actuates a solid state switch 137 which opens the hot gas valve 126 to send hot gas into the evaporator to melt the surfaces of the cubes adjacent the freezing elements 32.

Switch 70 also causes energization of the harvest motor 28 which, through linkage 24, causes the pan 22 to tilt and ultimately the false bottom 22 to be raised to cause dumping of the ice cubes onto a deflector 14 as waste water drops into the bin water pan 72. The ice cubes slide off the deflector 14 into the ice bin itself. Continued rotation of the output shaft of the harvest motor and the linkage causes the pan to return upwardly.

The harvest cycle is stopped and the freezing cycle started by two proximity switch actuators 142 and 144. Arm 142 contains a magnet 146 and arm 144 is pivoted to arm 142 and carries a magnet 148. The fixed arm 142 cooperates with a switch 150 and solid state switch 151 to prevent the accidental termination of the harvest cycle before the freezing pan 20 is in the horizontal solid line position of FIG. 1. The pivoted arm 144 cooperates with a switch 154 (FIGS. 4 and 9) to interrupt operation of the harvest motor at the exact dead center position of linkage 24, thereby locking the pan 20 in the highest position for the freezing cycle. Switch 154 also closes the hot gas solenoid valve 126 and energizes the agitator motor and the water solenoid. When the pan 20 is moving from the freezing position to the harvest position, switch 154 should not be pulsed. Accordingly, the pivoted arm 144 is arranged so that magnet 148 does not pass in an operative position with respect to switch 154 when the pan is moving to the discharge position. In this regard, the arm 144 remains in a transversely extending position with respect to arm 142, as shown in FIG. 1, as the pan 20 moves downwardly toward the harvest-discharge position in FIG. 4 and engages a peg 192 which flips the arm to the dotted line position in FIG. 4 where arm 144 is generally in line with arm 142 but projecting beyond the end thereof. A stop 193 on arm 142 maintains arm 144 in this position for a portion of the cycle. On return of the pan 20 from the harvest to the freezing cycle, a deflector 195 displaces arm 144 so that it pivots by gravity to the transverse position of FIG. 1.

The various features of the invention provide a reliable ice making machine with adjustment capabilities to suit the requirements of different users. The cam arrangement for oscillating the agitator paddles is not subject to appreciable wear and hence the thickness sensor does not require frequent adjustment. The use of proximity switches housed in a common module, with switch arms swinging past the same, greatly simplifies assembly and further reduces maintenance problems.

What is claimed is:

1. In an ice cube making machine comprising a frame, an evaporator and associated refrigeration circuit, said evaporator including freezing elements positioned in an ice forming pan containing water to cause cube formation upon the elements, said freezing elements being arranged in a plurality of spaced rows, means for supporting the pan for movement between a freezing condition and a dumping position, including a harvest motor to move said pan between said positions, comprising paddle means for agitating the water contained in said pan, and means for oscillating the paddles in said rows between said freezing elements and in a rectilinear horizontal path to provide clear, uniform cubes of ice.

2. The improvement of claim 1 wherein said means for oscillating said paddles comprises support rods connected to said paddles, bearing means for supporting said support rods, a cam follower connected to said rods, and an agitator motor having an output shaft with a cam engageable with said cam follower to reciprocate said rods during rotation of said motor output shaft.

3. In an ice cube making machine including a frame, an evaporator including freezing elements positioned in an ice forming pan containing water to cause cube formation upon the elements, means for supporting the pan for movement between a freezing condition and a dumping position, including a harvest motor to move said pan between said positions, the improvement comprising paddle means for agitating the water contained in said pan, and means for oscillating the paddles between said freezing elements and in a rectilinear path to provide clear, uniform cubes of ice and wherein said means for oscillating said paddles comprises support rods connected to said paddles, bearing means for supporting said support rods, a cam follower connected to said rods, and an agitator motor having an output shaft with a cam engageable with said cam follower to reciprodate said rods during rotation of said motor output shaft and including sensing means including a feeler arm to sense the thickness of an ice cube on a freezing element, means for adjustably supporting said feeler arm on one of said support rods to afford movement of said feeler arm in a path toward and away from a freezing element, and means supporting said feeler arm to afford displacement of said feeler arm when the thickness of a cube reaches a predetermined thickness, a circuit and switch actuator means associated with the feeler arm for actuating switch means in said circuit to stop oscillation of said agitator motor and energize said harvest motor when an ice cube on a freezing element reaches a predetermined thickness.

4. The improvement of claim 3 wherein said switch means is said circuit comprises a proximity switch and said switch actuator comprises a magnet carried by said feeler arm.

5. The improvement of claim 3 wherein said means for adjustably supporting said feeler arm includes a post, a collar connected to said post and said collar being axially shiftable on one of said support rods and said feeler arm being pivotally supported on said post.

6. In an ice cube making machine including a frame, a pan for holding water to be frozen supported on said frame for movement between freezing and harvest positions, an evaporator and associated refrigeration circuit, the evaporator having a plurality of freezing elements extending into the pan to cause formation of cubes about the freezing elements, the improvement comprising a circuit for controlling the freezing and harvest cycles, said circuit including switch means, an ice cube thickness sensor, means for moving said sensor in a rectilinear path toward and away from a freezing element, said sensor including a feeler arm, means for pivotally supporting said feeler arm to cause displacement of said feeler arm about said pivot means when ice buildup on a freezing element reaches a predetermined thickness and the ice is engaged by said feeler arm, and wherein said feeler arm carries a switch actuator to actuate said switch means and stop said freezing cycle and start the harvest cycle when said ice cube attains the predetermined thickness.

7. In an ice making machine including a water freezing pan which is supported for movement between a freezing position and a displaced dumping position, a refrigeration system including an evaporator having freezing elements located in said pan for forming ice cubes thereabout, and said circuit including a motor to cause agitation of water in said pan and a harvest motor for displacing the pan from the freezing position to the dumping position, and valves for controlling the discharge of water to the pan and hot gas into the freezing element for release of cubes from the elements during the harvest cycle, the improvement including a control module housing said circuitry, said circuit having first, second and third proximity switches located within said module, a thickness sensor for measuring the buildup of ice on a freezing element, said sensor including a pivoted feeler arm having a first switch actuator which moves adjacent to one side of said module and cooperates with said first proximity switch to initiate the harvest cycle by energizing said harvest motor, a second switch actuator fixed to said freezing pan and movable adjacent another side of said module to cooperate with said second proximity switch to stop said harvest motor and initiate said agitating motor upon return of said pan to said freezing position, and wherein said ice making machine has an ice cube bin sensor to sense the quantity of accumulated cubes in said bin, a linkage connecting said sensor to a third switch actuator which cooperates with said third proximity switch to de-energize said refrigeration system when the desired cube accumulation has been obtained.

8. In an ice making machine including a water freezing pan which is supported for movement between a freezing position and a displaced dumping position, a receptacle for catching water from the freezing pan including a drain pipe, a refrigeration system including an evaporator having freezing elements located in said pan for forming ice cubes thereabout, and said circuit including a motor to cause agitation of water in said pan and a harvest motor for displacing the pan from the freezing position to the dumping position, and valves for controlling the discharge of water to the pan and hot gas into the freezing element for release of cubes from the elements during the harvest cycle, the improvement including a control module housing parts of said circuitry, and a switch having parts in heat conductive relationship with one of said receptacle and said drain pipe to cool said switch.

* * * * *